US006463414B1

(12) United States Patent
Su et al.

(10) Patent No.: US 6,463,414 B1
(45) Date of Patent: Oct. 8, 2002

(54) CONFERENCE BRIDGE PROCESSING OF SPEECH IN A PACKET NETWORK ENVIRONMENT

(75) Inventors: Huan-Yu Su, San Clemente; Eyal Shlomot, Long Beach; Jes Thyssen, Laguna Niguel; Adil Benyassine, Irvine; Yang Gao, Mission Viezo, all of CA (US)

(73) Assignee: Conexant Systems, Inc., Newport Beach, CA (US)

( * ) Notice: Subject to any disclaimer, the term of this patent is extended or adjusted under 35 U.S.C. 154(b) by 0 days.

(21) Appl. No.: 09/547,832

(22) Filed: Apr. 12, 2000

Related U.S. Application Data

(60) Provisional application No. 60/128,873, filed on Apr. 12, 1999.

(51) Int. Cl.[7] ..... G10L 11/02

(52) U.S. Cl. ..... 704/270.1; 704/207; 704/270; 704/500

(58) Field of Search ..... 704/270, 200, 704/200.1, 207, 270.1, 201, 500

(56) References Cited

U.S. PATENT DOCUMENTS 4,131,760 A * 12/1978 Christensen et al. ..... 381/66
4,581,758 A * 4/1986 Coker et al. ..... 367/125
5,610,991 A * 3/1997 Janse ..... 381/13
5,629,736 A * 5/1997 Haskell et al. ..... 348/386.1
5,920,546 A 7/1999 Herbert et al.
5,995,923 A 11/1999 Mermelstein et al.
6,219,645 B1 * 4/2001 Byers ..... 381/91
6,222,927 B1 * 4/2001 Feng et al. ..... 381/92

OTHER PUBLICATIONS

Article entitled "Improving Transcoding Capability of Speech Codes in Clean and Frame Erasured Channel Environments", by Hong–Goo Kang, et. al. (AT&T Labs–Research, SIPS), IEEE 2000, pp. 78–80.

* cited by examiner

*Primary Examiner*—Richemond Dorvil

(57) ABSTRACT

There is provided a conference bridge or transcoder configured to intelligently handle multiple speech channels in the contest of a packet network, wherein various speech channels may adhere to variety of speech encoding standards. For example, the conference bridge establishes framing and alignment of multiple incoming speech channels associated with multiple participants, extracts parameters from the speech samples, mixes the parameters, and re-encodes the resulting speech samples for transmission to the participants. In one aspect, a speech processing method comprises decoding a first bitstream according to a first coding scheme to generate first speech samples and a first side information; generating second speech samples and a second side information using the first speech samples and the first side information, for use according to a second coding scheme; and creating a second bitstream, encoded based on the second coding scheme, using the second speech samples and the second side information.

31 Claims, 3 Drawing Sheets

CONFERENCE BRIDGE PROCESSING OF SPEECH IN A PACKET NETWORK ENVIRONMENT

RELATED APPLICATIONS

This application claims priority based on U.S. provisional application Ser. No. 60/128,873, filed Apr. 12, 1999, hereby incorporated by reference.

FIELD OF THE INVENTION

The present invention relates, generally, to the transmission of voice over packet networks and, more particularly, to techniques for improving voice-over-IP (VoIP) conference bridges and transcoders.

BACKGROUND OF THE INVENTION

The explosive growth of the Internet has been accompanied by a growing interest in using this traditionally data-oriented network for voice communication in accordance with voice-over-packet (VoP) or voice-over-IP (VoIP) technology.

In traditional switched networks, conference calls—where multiple participants engage in simultaneous conversation with each other—are enabled by a conference bridge which typically resides within the central office. In a switched network, all conference participants are simply connected to the conference bridge, which mixes the speech from the various speakers and feeds the mixed signal back to the participants.

In the context of packet networks, the various packets from the participants are routed to the IP-based conference bridge. The speech information from the speakers is obtained, de-packetized, and decoded. The mixed speech is then re-encoded, packetized, and sent back over the packet network to the conference call participants.

Known conference bridge solutions are inadequate in a number of respects. For example, the decoding and re-encoding of the speech signal (a "tandem" process), reduces the quality of the speech. More particularly, the tandem operation of the post-filter, common in low bit-rate speech decoders, generates objectionable spectral distortion. This is especially noticeable in cases where different speech coding standards are used for the various input speech channels.

Known conference bridge solutions are also inadequate due to the limitations of the mixing scheme used to combine the multiple input channels. Conventional systems sum the decoded speech signals and then re-encode the mixed speech for output. This can be a problem in cases where several participants attempt to talk at the same time, as the limited order of the representation is typically not suitable for the representation of mixed speech. Furthermore, even in the case of a single speaker, the re-estimation of the spectrum during re-encoding generations a significant degradation in the second encoding. Furthermore, the re-estimation of the spectrum requires additional buffering of speech samples, resulting in an additional speech delay at the conference bridge.

Known bridge designs are also unsatisfactory in that, while the background noise level from a single participant may be relatively low, the addition of multiple channels, each having their own noise component, can result in a combined noise level that is intolerable.

Typical conference bridge systems are also inadequate in that the speech of each participant is mixed without any priority assignment. When a number of participants attempt to speak at the same time, the resulting output can be unintelligible. Furthermore, handling returned echo from multiple participants can be a major problem in conference bridges operating in a frame-based packet network environment.

Systems and methods are therefore needed to overcome these and other limitations of the prior art.

SUMMARY OF THE INVENTION

The present invention provides a conference bridge or transcoder configured to intelligently handle multiple speech channels in the context of a packet network, wherein the various speech channels may adhere to a variety of speech encoding standards. In general, the conference bridge establishes framing and alignment of multiple incoming speech channels associated with multiple participants, extracts parameters from the speech samples, mixes the parameters, and re-encodes the resulting speech samples for transmission back to the participants. In accordance with other aspects of the present invention, priority assignment and speech enhancement (e.g., noise reduction, reshaping, etc.) are performed.

BRIEF DESCRIPTION OF THE DRAWINGS

A more complete understanding of the present invention may be obtained by referring to the detailed description and claims when considered in connection with the following illustrative Figures, wherein like reference numbers refer to similar elements throughout the Figures and:

DETAILED DESCRIPTION OF PREFERRED EXEMPLARY EMBODIMENTS

The present invention may be described herein in terms of functional block components and various processing steps. It should be appreciated that such functional blocks may be realized by any number of hardware components or software elements configured to perform the specified functions. For example, the present invention may employ various integrated circuit components, e.g., memory elements, digital signal processing elements, logic elements, look-up tables, and the like, which may carry out a variety of functions under the control of one or more microprocessors or other control devices. In addition, those skilled in the art will appreciate that the present invention may be practiced in conjunction with any number of data and voice transmission protocols, and that the system described herein is merely one exemplary application for the invention.

It should be appreciated that the particular implementations shown and described herein are illustrative of the invention and its best mode and are not intended to otherwise limit the scope of the present invention in any way.

Indeed, for the sake of brevity, conventional techniques for signal processing, data transmission, signaling, packet-based transmission, network control, and other functional aspects of the systems (and components of the individual operating components of the systems) may not be described in detail herein. Furthermore, the connecting lines shown in the various figures contained herein are intended to represent exemplary functional relationships and/or physical couplings between the various elements. It should be noted that many alternative or additional functional relationships or physical connections may be present in a practical communication system.

I. Overview

Figure 1:
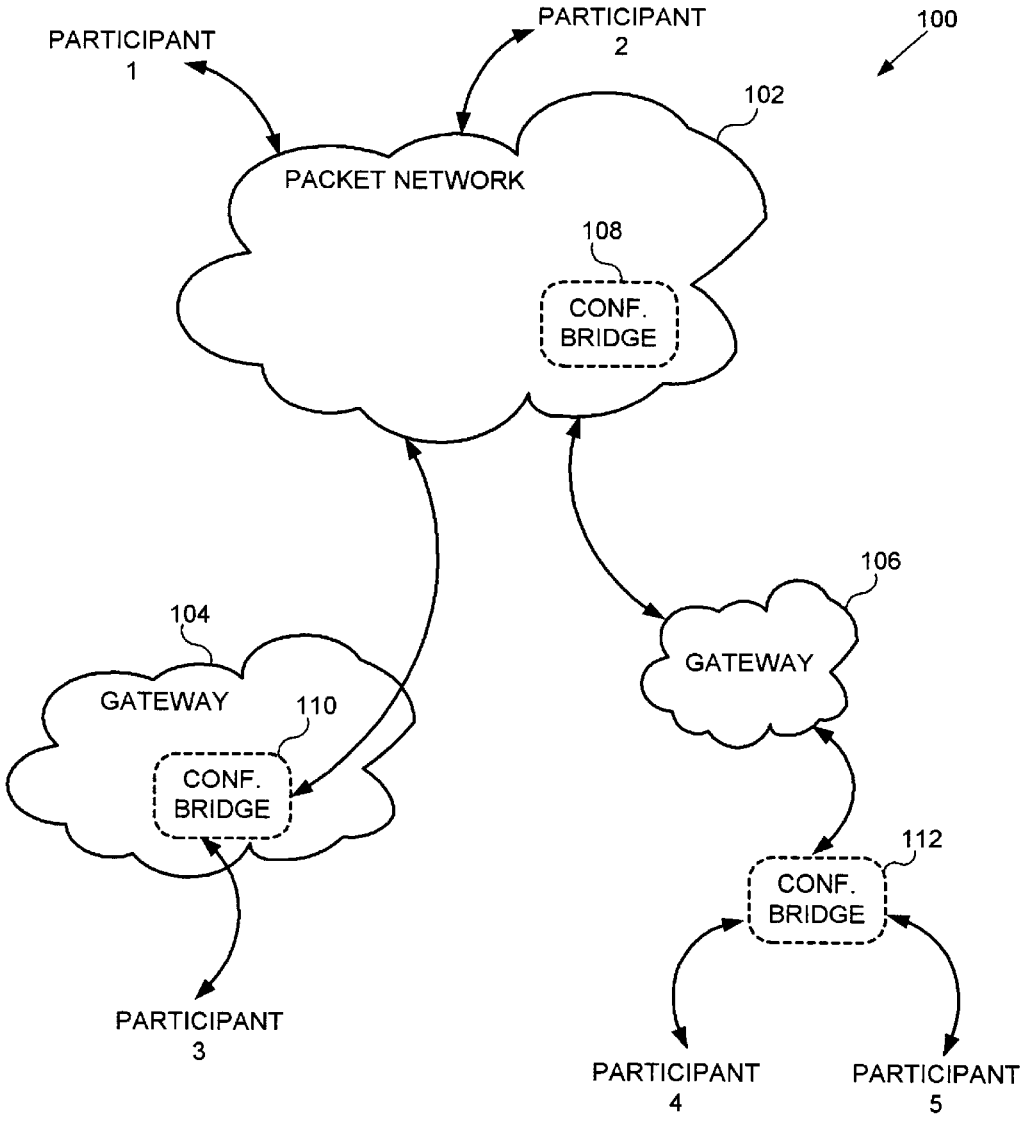
FIG. 1 is a block diagram representation of a packet-based network in which various aspects of the present invention may be implemented.

FIG. 1 depicts an exemplary packet network environment 100 that is capable of supporting the transmission of voice information. A packet network 102, e.g., a network conforming to the Internet Protocol (IP), may support Internet telephony applications that enable a number of participants to conduct voice calls in accordance with conventional voice-over-packet techniques. In a practical environment 100, packet network 102 may communicate with conventional telephone networks, local area networks, wide area networks, public branch exchanges, and/or home networks in a manner that enables participation by users that may have different communication devices and different communication service providers. For example, in FIG. 1, Participant 1 and Participant 2 communicate with packet network 102 (either directly or indirectly) via the transmission of packets that contain voice data. Participant 3 communicates with packet network 102 via a gateway 104, while Participant 4 and Participant 5 communicate with packet network 102 via a gateway 106.

In the context of this description, a gateway is a functional element that converts voice data into packet data. Thus, a gateway may be considered to be a conversion element that converts conventional voice information into a packetized form that can be transmitted over a packet network. A gateway may be implemented in a central office, in a peripheral device (such as a telephone), in a local switch (e.g., one associated with a public branch exchange), or the like. The functionality and operation of such gateways are well known to those skilled in the art, and will therefore not be described in detail. It will be appreciated that the present invention can be implemented in conjunction with a variety of conventional gateway designs.

Packet network environment 100 may include any number of conference bridges that enable a plurality of participants. In practice, conference bridges are typically used when there are at least three participants who wish to join in a single call. For example, a conference bridge 108 may be included in packet network 102. Conference bridge 108 may be implemented in a central office or maintained by an Internet service provider (ISP). In this manner, the speech data from a number of packet-based participants, such as Participant 1 and Participant 2, can be processed by conference bridge 108 without having to perform the conversions normally performed by gateways.

As another example, a conference bridge 110 may be associated with or included in a gateway, e.g., gateway 104. In this configuration, conference bridge 110 may be capable of receiving and processing voice-over-packet data and conventional voice signals. Eventually, gateway 104 enables conference bridge 110 to further communicate with packet network 102 and other participants. In another practical application, a conventional conference bridge 112 (which may be capable of processing speech signals from any number of conventional telephony devices) can communicate a mixed speech signal to packet network 102 via gateway 106. In this manner, the voice signals from a number of participants can be initially mixed in a conventional manner prior to being further mixed in accordance with the packet-based techniques described herein.

In accordance with the present invention, a packet-based conference bridge may be deployed in a telephony system to facilitate the conference bridging of at least one packet-based voice channel with a number of other voice channels (regardless of whether such other channels are packet-based). As mentioned above, a given packet-based voice channel may employ one of a number of different speech coding/compression techniques. Speech coding techniques that are generally known to those skilled in the art include G.711, G.726, G.728, G.729(A), and G.723.1, the specifications for which are hereby incorporated by reference.

The particular technique utilized for a given call may depend on the participant's Internet service provider, the telephone service provider, the design of the participant's peripheral device, and other factors. Consequently, a practical packet-based conference bridge should be capable of handling a plurality of speech channels that have been encoded by different techniques. In addition, such a conference bridge should be capable of handling any number of conventional speech channels that have not been encoded.

As will be detailed below, a conference bridge in accordance with the present invention provides an intelligent scheme for handling multiple speech channels in the context of a packet network wherein the various speech channels may adhere to a variety of speech encoding standards. In general, the conference bridge establishes framing and alignment of multiple incoming speech channels. Parameter extraction is then performed (in the case of non-parametric coders), and the parameters of the input channels are then mixed and re-encoded for the output channels. Depending on the particular embodiment, priority assignment and speech enhancement (e.g., noise reduction, reshaping, etc.) are performed in connection with the multiple input and output channels.

Figure 2:
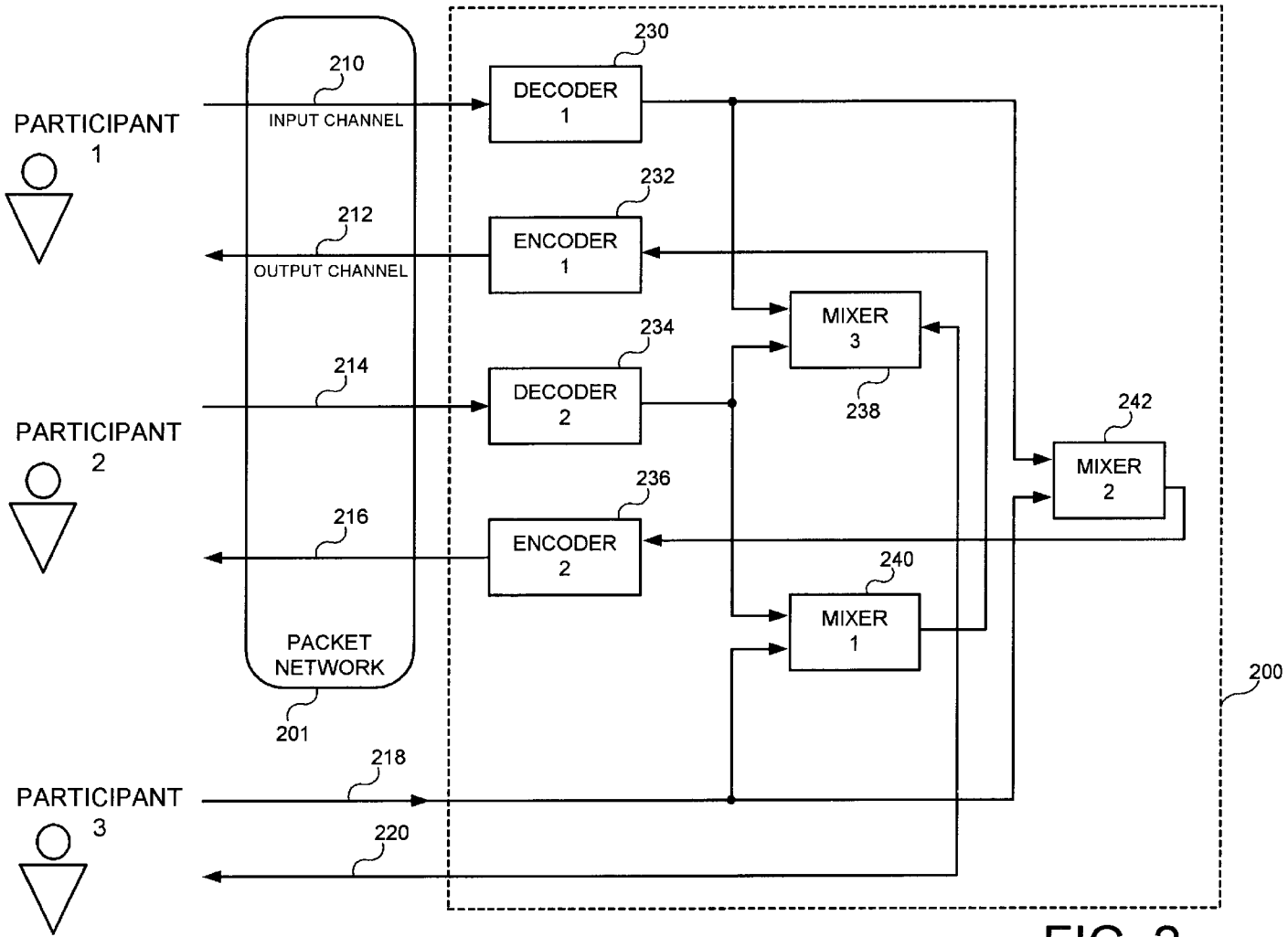
FIG. 2 is a block diagram representation of a packet-based conference bridge.

Referring now to FIG. 2, multiple participants—two communicating through a packet network, and one communicating locally—engage in a conference call utilizing a conference bridge 200, wherein input channel 210 and output channel 212 are associated with participant 1, input channel 214 and output channel 216 are associated with participant 2, and input channel 218 and output channel 220 are associated with participant 3.

As illustrated in this example, participants 1 and 2 are coupled to conference bridge 200 via packet network 201, and participant 3 is coupled to conference bridge 200 locally, e.g., through the PBX or other suitable voice connection. It will be appreciated by those skilled in the art that input and output data transmitted over packet network 201 (i.e., through channels 210, 212, 214, and 216) will consist of digital data in packet form in accordance with one or more encoding standards, and that input and output data transmitted locally (i.e., through channels 218 and 220) may be a digital bit-stream, but is not necessarily packetized.

In the illustrated embodiment, conference bridge 200 includes a decoder 230 and encoder 232 coupled to channels 210 and 212 respectively for participant 1, and a decoder 234 and encoder 236 coupled to channels 214 and 216 respectively for participant 2. The output of decoder 230 (decoded speech from participant 1) is coupled to mixers 238 and 242; likewise, the output of decoder 234 (decoded speech from participant 2) is coupled to mixers 238 and 240. The uncoded input 218 from participant 3 is coupled to mixers 240 and 242.

The output of mixer 240 is encoded by encoder 232 and transmitted to participant 1 over output channel 212 (through packet network 201), and the output of mixer 242 is encoded by encoder 236 and transmitted to participant 2 via output channel 216. The output of mixer 238 is transmitted to local participant 3 directly through channel 220—i.e., without the use of a decoder.

Decoders 230 and 234 include suitable hardware and/or software components configured to convert the incoming packet data into speech samples to be processed by the appropriate mixers. Similarly, encoders 232 and 236 are suitably configured to convert the incoming speech samples into packetized data for transmission over packet network 201.

FIG. 2 is a simplified schematic: there might also be certain additional components advantageously coupled between the packet network and the decoders (and encoders). Specifically, with respect to the decoders, there. will likely be a functional block (not shown) that receives the packets from packet network 201 and removes all unnecessary routing, encryption, and protection information (a "decapsulator"). Conversely, with respect to the encoders, there will likely be a functional block (an "encapsulator") for each encoder that receives speech samples from the mixer and adds certain information regarding routing, encryption, and the like prior to sending the packets out over packet network 201.

It will also be appreciated that if only participant 1 and participant 2 of FIG. 2 are involved in the call, the conference bridge is effectively reduced to a transcoding system. Thus, various aspects of the present invention are not limited to use in a conference involving three or more participants; the present invention may also be employed in connection with person-to-person transcoding and other contexts.

II. Mixing Using Framing, Alignment, and Interpolation

As described above in conjunction with FIG. 2, speech data from multiple input channels, which may use different encoding standards, is decoded, mixed, and re-encoded for output to the participants. It will be appreciated that the incoming packets a characterized by a discrete frame size, which may be expressed as a time period (e.g., 10 ms) or sample length (e.g., 80 samples), the relationship between which is determined by the sampling rate (e.g., 8,000 samples per second).

Depending upon which encoding standard is used, the frame size for a series of speech samples produced by a decoder may vary greatly. For example, G.723 uses a frame size of 30 ms, and G.729 uses a frame size of 10 ms. Thus, as a preliminary matter, a common frame structure must be established to enable intelligent mixing of speech samples. In accordance with one embodiment of the present invention, the largest frame size of the input channels may be used. For example, if at least one of the input channels is encoded using G.723, then a 30 ms frame is established. Alternatively, a frame size equal to the least common multiple might be used. For example, in the case where one channel is encoded using G.723 (30 ms frame), and another channel is encoded using G.4k (20 ms frame), a 60 ms frame may be established.

Once a frame size is determined, the samples are properly interpolated and aligned during mixing. That is, it will be appreciated that when one series of speech samples using one encoding standard is compared to another series of speech samples using another encoding standard, the samples might be shifted in time with respect to each other. Some samples may occur in the center of their respective frame, and others may occur toward the end or beginning of their frame. In accordance with the present invention, the parameters from short-length frames are suitably buffered and aligned to the parameters from the long-length frames, and from the long-length frames to the short-length frames.

The various conventional methods by which speech parameters are mixed and interpolated are known in the art. For example, the spectrums of two samples may be summed using a standard weighted addition: The same may be done for other parameters, such as pitch and energy.

Parameter Extraction and Side Information

A portion of the tandem or transcoding degradation is due to errors in pitch and spectral estimation in the second encoder. In accordance with the present invention, as the decoders of the first coding stage reside in the same location as the encoders of the second stage, this degradation can be substantially eliminated. In accordance with one aspect of the present invention, the system transmits, in addition to the speech samples, several speech parameters from the decoders to the mixers, and from the mixers to the encoders, wherein each of the speech samples are characterized by a set of parameters, e.g., spectrum, pitch, and energy. These parameters are, in certain contexts, referred to herein as "side information. " It will be appreciated that other parameters may also be defined.

Figure 5:
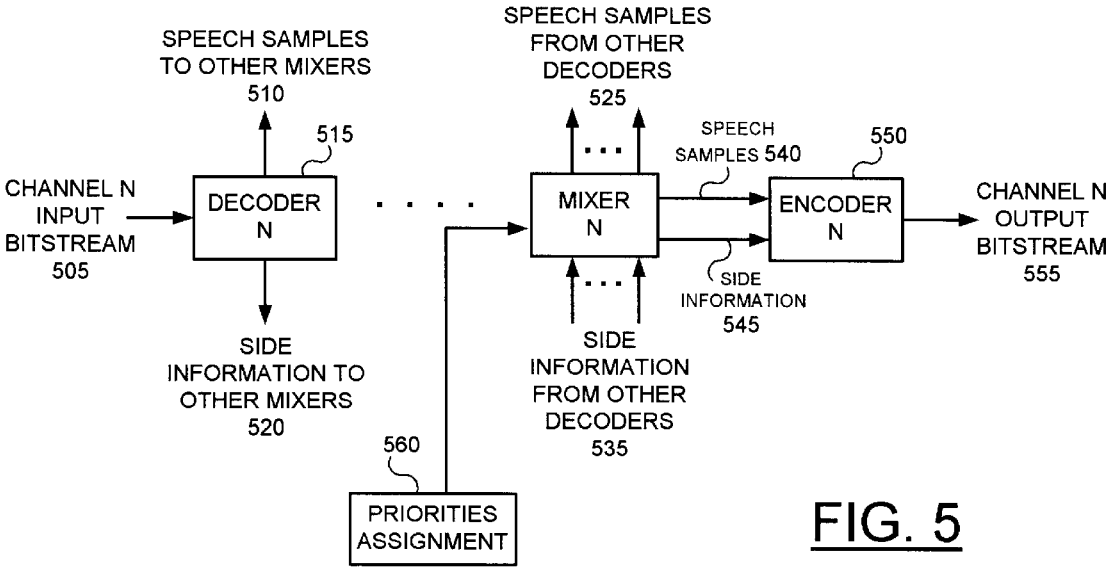
FIG. 5 is a block diagram representation of a speech channel in a packet-based conference bridge.

In this regard, a data path in accordance with the present invention for a channel n is shown in FIG. 5. The input bit stream for channel n (505) is extracted from the packets received over the packet network from the nth participant in the conference call, and is the input to the decoder of channel n (515). The decoder of channel n (515) decodes the bit stream, and generates both the speech samples for channel n (510), and the side information for channel n (520). The speech samples 510 and the side information 520 are distributed to other mixers in the conference bridge. At the same time, the speech samples from other channels (525) and the side information from all other channels (535) are input to the mixer of channel n (530). The mixer uses the speech samples and the side information to generate the combined speech samples (550) and the combined side information (545), which are used by the encoder of channel n (550) to generate the combined bit stream for the channel. The bit stream is then packetized and send through the network to the nth participant in the conference call.

Modifications to Standard Decoder

In accordance with one embodiment of the present invention, intelligent mixing is implemented by modifying the standard decoders and encoders, and designing the mixers to process side information as detailed above.

For example, it is advantageous to disable the post-filters commonly included in conference decoders in order to avoid spectral degradation in tandem coding. It is also possible to otherwise enhance the standard encoders for tandem coding, e.g., by implementing better pitch and spectrum tracking algorithms, thereby compensating for pitch and spectral fluctuations due to the first encoding stage. As those skilled in the art will realize, these and other modifications may be accomplished through convention software/hardware techniques in accordance with the function or algorithms being optimized.

Figure 3:
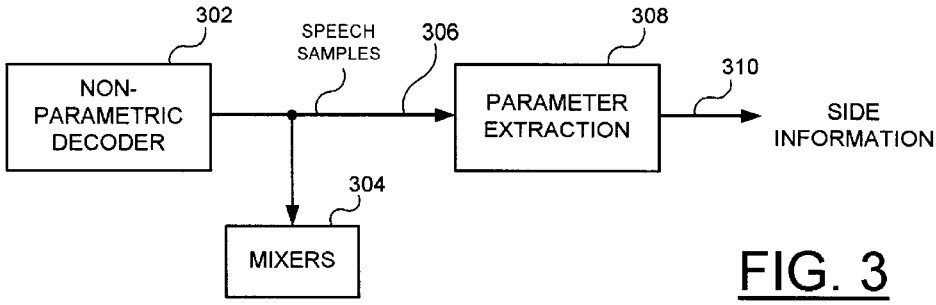
FIG. 3 is a block diagram representation of a section of a packet-based conference bridge having non-parametric decoding capabilities.

Parametric speech coding methods such as G.729 and G.723.1 quantize and make available various parameters (e.g., pitch and spectrum) which can be easily channeled to the appropriate mixers. Parameter extraction may also be implemented in a non-parametric context using the system shown in FIG. 3. The non-parametric decoder 302 produces speech samples 306 which are sent to the mixers (304) and also sent to a parameter extraction block 308, which extracts the desired parameters (e.g., pitch, energy, and spectrum), and produces the side information 310 used by the mixers as described above in connection with FIG. 5.

Spectral and Pitch Mixing

In accordance with one aspect of the present invention, spectral parameters extracted from the speech samples are used for spectral mixing in the conference bridge, thereby replacing spectral re-evaluation during re-encoding. This spectral mixing may be performed using any convenient representation for the spectral parameters. In a preferred embodiment, for example, spectral mixing is accomplished using line spectral frequencies (LSFs) or the cosines of the LSFs. By using the available parameters, rather than re-evaluating them, a better spectral representation results by emphasizing the dominant speaker, avoiding the degradation resulting form spectral re-evaluation for a single speaker, reducing the complexity of the process, and eliminating the need for additional buffering and delay.

The spectral mixing may be signal driven, e.g., based on the relative energy of the talker. The mixing may also take into account timing considerations (e.g., slow change of spectral emphasis) and external considerations, such as priority and emphasis assignment for different participants (described in further detail below).

In accordance with another aspect of the present invention, pitch parameters available at the output of the decoder are used in place of the pitch re-evaluation process. That is, as described above in connection with the spectrum parameter, a dominant pitch is determined and emphasized to avoid the degradation attending pitch re-evaluation for a single talker.

III. Priorities Assignment

In traditional conference bridge systems, the various input channels are mixed in a manner which does not privilege one speaker over the others. In many contexts this may be appropriate; in other cases, however, it may be advantageous to assign a priority level to one or more speakers in order to help manage and control the call. This assignment may be accomplished in a number of ways. For example, in accordance with one embodiment of the present invention, one or more of the speech parameters (e.g., energy) is monitored to determine which speaker is in fact dominating the discussion. The channel for that speaker is then automatically given higher priority during mixing. This embodiment would help in situations where many people are speaking at once, and the intelligibility of all the speakers is lost.

In accordance with another embodiment, priority assignments are determined a priori. That is, a decision is made at the outset that a single participant or a group of participants (e.g., the board of directors, or the like) are more important for the purpose of the conference call, and a higher priority is assigned to that participant's input channel using any suitable method Note that more complex priority assignments may be made. That is, rather than simply assign priority to a single channel, a list or matrix of priorities may be assigned to the various participants, and that list of priorities can be used in mixing.

In any event, the priority assignment can be used as a criterion for adjusting the energy, pitch, spectrum and/or other parameters of the incoming channels. This functionality is shown in FIG. 5, wherein a priorities assignment block 560 feeds into mixer n (525).

IV. Echo Cancellation

The primary purpose of any conference bridge is to allow the participants to hear the other participants. If all the speech channels are mixed into a single channel which is fed to all the participants, each participant will receive and hear his or her own speech. Since such conference bridges involve grouping several speech samples into a frame, a significant delay can be introduced between the articulation of the speech and the voicing of the speech at the conference bridge. The speech can actually be delayed tens or hundreds of milliseconds, resulting in an exceedingly annoying return echo.

It is an advantage of the present invention that the architecture of the embodiment shown in FIG. 2 inherently implements return echo cancellation. For example, participant 2 receives, through channel 216, the output of mixer 242, where mixer 242 takes its input from the decoded speech of participants 1 and 3. The speech from participant 2 does not return to participant 2.

It will be appreciated that the topology shown in FIG. 2 can be expanded to any number of participants. In general, if there are N participants in the call, N mixed signals are generated, each composed of N−1 speech channel inputs, excluding the speech of one particular participant. That is, the mixed signal without the n-th channel is fed back as the output to the n-th channel. As the contribution of the n-th speaker is not included in this mix, the returned echo is effectively eliminated.

V. Background Noise

It is possible that one or more of the participants in the conference call is located in a noisy environment. The level of background noise can be quite high, for example, if a participant is talking from a mobile station in a noisy street, car, bus, or the like. The background noise might also be very low, for example, if the participant is located in a quiet office with a low level of air conditioning noise.

Although the noise contributed from any given participant might be tolerable in a regular conversation, the addition of the input channels during mixing can severely reduce the signal-to-noise ratio (SNR), and the noise level might become excessive. For example, given a call of eight participants, where each speaker has an ambient noise of about 25 dB SNR, each listener will experience a SNR of about 16 dB, which is considered an intolerable level.

Figure 4:
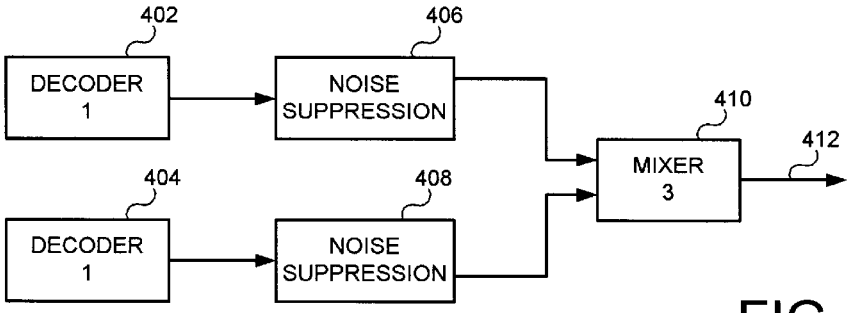
FIG. 4 is a block diagram representation of a section of a packet-based conference bridge having noise suppression capabilities.

In accordance with one embodiment of the present invention, noise suppression modules are used to suppress the ambient noise for each input channel. Each noise suppressor operates on the decoded speech from an input channel, which includes the noise contribution from the remote end of the channel. The suppression of noise for each channel will reduce the noise of the mixed signal, and will enhance the quality of the perceived speech at each output channel. Referring now to FIG. 4, the outputs of decoders 402 and 404 are coupled to noise suppressors 406 and 408 respectively, wherein the output of the noise suppressors enters mixer 410, producing an output 412. Noise suppression may be accomplished within modules 406 and 408 using a variety of conventional techniques.

In another embodiment, noise reduction is accomplished by modifying the encoder and/or decoder at the conference bridge in order to improve the representation of background noise. This modification may take a number of forms, and may include a number of additional functional blocks, such as an anti-sparseness filter, which reduces the spiky nature of background noise representation in G.729 and G.723.1 decoders. The encoders may employ modified search methods, such as combined closed-loop and energy matching measures, for improved representation of the background noise.

In accordance with another embodiment, partial muting of the signal from a non-active participant (as determined using a VAD) is employed. This scheme may be employed in conjunction with the encoder/decoder modification embodiment or noise-suppressor embodiment previously described.

The present invention has been described above with reference to various aspects of a preferred embodiment. However, those skilled in the art having read this disclosure will recognize that changes and modifications may be made to the preferred embodiment without departing from the scope of the present invention. These and other changes or modifications are intended to be included within the scope of the present invention, as expressed in the following claims.

What is claimed is:

1. A conference bridge apparatus for facilitating communication between a first participant, a second participant, and a third participant, said conference bridge comprising:

a first decoder having an input and an output, wherein said input is coupled to a packet network, and wherein said second decoder is configured to receive and decode speech information from said first participant;

a second decoder having an input and an output, wherein said input is coupled to said packet network, and wherein said second decoder is configured to receive and decode speech information from said second participant;

a first encoder having an input and an output, wherein said output is coupled to said packet network, and wherein said first encoder is configured to encode speech samples for transmission over said packet network;

a second encoder having an input and an output, wherein said output is coupled to said packet network, said wherein said second encoder is configured to encode speech samples for transmission over said packet network;

a first mixer having a first input, a second input, and an output, said first input of said first mixer coupled to said output of said second decoder, said second input of said first mixer configured to receive speech from said third participant, and said output of said first mixer coupled to said input of said first encoder;

a second mixer having a first input, a second input, and an output, said first input of said second mixer coupled to said output of said first decoder, said second input of said second configured to receive speech information from said third participant, and said output of said second mixer coupled to said input of said second encoder;

a third mixer having a first input, a second input, and an output, said first input of said third mixer coupled to said output of said first decoder, said second input of said third mixer coupled to said output of said second decoder, and said output of said third mixer configured to transmit speech information to said third participant;

wherein said first, second, and third mixers are configured to mix their respective inputs in accordance with a parameter extracted from said inputs.

2. A speech processing system for facilitating communication between a first participant and a second participant, said speech processing system comprising:

a first decoder capable of receiving a first bitstream of said first participant encoded based on a first coding scheme, decoding said first bitstream according to said first coding scheme and generating a plurality of first speech samples and a first side information;

an aligner capable of using said plurality of first speech samples and said first side information to generate a plurality of second speech samples and a second side information for use according to a second coding scheme;

an encoder capable of using said plurality of second speech samples and said second side information to generate a second bitstream encoded based on said second coding scheme for said second participant.

3. The speech processing system of claim 2, wherein said first side information includes a spectrum information.

4. The speech processing system of claim 2, wherein said first side information includes a pitch information.

5. The speech processing system of claim 2, wherein said first side information includes an energy information.

6. The speech processing system of claim 2, wherein said first coding scheme is characterized by a plurality of first frames of a first frame size and said second coding scheme is characterized by a plurality of second frames of a second frame size, and wherein said aligner buffers and aligns a plurality of parameters of said plurality of first frames to generate said plurality of second speech samples and said second side information for use according to said second coding scheme.

7. The speech processing system of claim 2 for further facilitating communication with a third participant, said speech processing system further comprising:

a second decoder capable of receiving a third bitstream of said third participant encoded based on a third coding scheme, decoding said third bitstream according to said third coding scheme and generating a plurality of third speech samples and a third side information;

wherein said aligner is capable of combining said plurality of first speech samples and said first side information with said plurality of third speech samples and said third side information to generate said plurality of second speech samples and said second side information.

8. A speech processing method for use in facilitating communication between a first participant and a second participant, said speech processing method comprising:

receiving a first bitstream of said first participant encoded based on a first coding scheme;

decoding said first bitstream according to said first coding scheme to generate a plurality of first speech samples and a first side information;

generating a plurality of second speech samples and a second side information, for use according to a second coding scheme, using said plurality of first speech samples and said first side information; and creating a second bitstream, encoded based on said second coding scheme for said second participant, using said plurality of second speech samples and said second side information.

9. The speech processing method of claim 8, wherein said first side information includes a spectrum information.

10. The speech processing method of claim 8, wherein said first side information includes a pitch information.

11. The speech processing method of claim 8, wherein said first side information includes an energy information.

12. The speech processing method of claim 8, wherein said first coding scheme is characterized by a plurality of first frames of a first frame size and said second coding scheme is characterized by a plurality of second frames of a second frame size, and wherein in said generating a plurality of parameters of said plurality of first frames are buffered and aligned to generate said plurality of second speech samples and said second side information for use according to said second coding scheme.

13. The speech processing method of claim 12 for further use in facilitating communication with a third participant, said speech processing method further comprising:

receiving a third bitstream of said third participant encoded based on a third coding scheme;

decoding said third bitstream according to said third coding scheme to generate a plurality of third speech samples and a third side information;

wherein said generating includes combining said plurality of first speech samples and said first side information with said plurality of third speech samples and said third side information to generate said plurality of second speech samples and said second side information.

14. A conference bridge for facilitating communication between a first participant, a second participant and third participant, said conference bridge comprising:

a first decoder capable of receiving a first bitstream of said first participant, decoding said first bitstream and generating a first speech information;

a second decoder capable of receiving a second bitstream of said second participant, decoding said second bitstream and generating a second speech information;

a first mixer capable of combining said first speech information with said second speech information to generate a third speech information; and a first encoder capable of using said third speech information to generate a third bitstream for said third participant;

wherein said first speech information includes a plurality of first speech samples and a first side information, said second speech information includes a plurality of second speech samples and a second side information and said third speech information includes a plurality of third speech samples and a third side information.

15. The conference bridge of claim 14, wherein said first side information, said second side information and said third side information include spectrum information.

16. The conference bridge of claim 14, wherein said first side information, said second side information and said third side information include pitch information.

17. The conference bridge of claim 14, wherein said first side information, said second side information and said third side information include energy information.

18. The conference bridge of claim 14 further comprising:

a third decoder capable of receiving a third bitstream of said third participant, decoding said third bitstream and generating a fourth speech information;

a second mixer capable of combining said first speech information with said fourth speech information to generate a fifth speech information; and a second encoder capable of using said fifth speech information to generate a fourth bitstream for said second participant.

19. The conference bridge of claim 14, wherein said first mixer prioritizes first speech information with respect to said second speech information.

20. The conference bridge of claim 19, wherein said first mixer prioritizes based on one or more speech parameters.

21. The conference bridge of claim 19, wherein said first mixer prioritizes based on a predetermined participant.

22. The conference bridge of claim 14, wherein a noise suppression is applied after decoding said first bit stream.

23. A conferencing method for facilitating communication between a first participant, a second participant and third participant, said conferencing method comprising:

receiving a first bitstream of said first participant;

decoding said first bitstream to generate a first speech information;

receiving a second bitstream of said second participant;

decoding said second bitstream to generate a second speech information;

combining said first speech information with said second speech information to generate a third speech information; and generating a third bitstream, for said third participant, using said third speech information;

wherein said first speech information includes a plurality of first speech samples and a first side information, said second speech information includes a plurality of second speech samples and a second side information and said third speech information includes a plurality of third speech samples and a third side information.

24. The conferencing method of claim 23, wherein said first side information, said second side information and said third side information include spectrum information.

25. The conferencing method of claim 23, wherein said first side information, said second side information and said third side information include pitch information.

26. The conferencing method of claim 23, wherein said first side information, said second side information and said third side information include energy information.

27. The conferencing method of claim 23 further comprising:

receiving a third bitstream of said third participant;

decoding said third bitstream to generate a fourth speech information;

combining said first speech information with said fourth speech information to generate a fifth speech information; and generating a fourth bitstream, for said second participant, using said fifth speech information.

28. The conferencing method of claim 23, wherein said first mixer prioritizes first speech information with respect to said second speech information.

29. The conferencing method of claim 28, wherein said first mixer prioritizes based on one or more speech parameters.

30. The conferencing method of claim 28, wherein said first mixer prioritizes based on a predetermined participant.

31. The conferencing method of claim 23, wherein a noise suppression is applied after decoding said first bit stream.

* * * * *